United States Patent [19]

Wilson et al.

[11] Patent Number: 4,552,190

[45] Date of Patent: Nov. 12, 1985

[54] FILLING MACHINES

[75] Inventors: Robert H. Wilson; Andrew J. Wilson, both of Glasgow, Scotland

[73] Assignee: James Hamilton & Sons (Engineering) Ltd., Glasgow, Scotland

[21] Appl. No.: 608,468

[22] Filed: May 9, 1984

[30] Foreign Application Priority Data

May 16, 1983 [GB] United Kingdom ..... 8313382

[51] Int. Cl.[4] ..... B65B 43/42

[52] U.S. Cl. ..... 141/82; 99/453; 141/153

[58] Field of Search ..... 53/64; 99/453; 141/11, 141/82, 139, 153

[56] References Cited

U.S. PATENT DOCUMENTS

| | | | |
|---|---|---|---|
| 644,325 | 2/1900 | Kammerer | 141/82 X |
| 2,887,391 | 5/1959 | Jacobssen et al. | 141/11 X |
| 4,019,545 | 4/1977 | Vinatieri | 141/153 X |

*Primary Examiner*—Stephen Marcus

*Assistant Examiner*—Mark Thronson

*Attorney, Agent, or Firm*—Bell, Seltzer, Park & Gibson

[57] ABSTRACT

An integrated filling and pasteurizing apparatus comprising a filling machine and a pasteurizing machine. The pasteurizing machine having a balance tank for temporary storage of the product to be pasteurized, and a pasteurizing station coupled to receive the product from the balance tank and to deliver the pasteurized product to the filling machine. The filling machine includes a hopper coupled to receive pasteurized product from the pasteurizing station, a container-filling station connected to the output of the hopper, and drive mechanisms for sequentially delivering containers to be filled to the filling station and for sequentially moving filled containers from the filling station to a container-closure station. Control mechanisms provide controlled operation of the drive mechanisms permitting synchronous operation of the pasteurizing machine and of the filling machine and include liquid level sensor devices assoicated with the hopper of the filling machine for governing the indexing rate of the drive mechanisms.

3 Claims, 4 Drawing Figures

FILLING MACHINES

This invention relates to filling machines.

Filling machines for filling containers with potable liquids are already known in various configurations. The potable liquids may be milk, water, beer, fruit juices, wines or the like and the containers may be cartons, bottles or cans. In these known filling machines the liquid to be containerised is held in a bulk storage vessel and is intermittently delivered in measured volumetric quantities to a filling station at which a succession of empty containers is presented for respectively receiving a quantity of liquid sufficient to fill a container, each filled container is then removed from the filling station and is presented to at least one other station whereat the filled container is sealed.

In order to render liquids potable throughout the expected duration within the container, that is fit for human consumption throughout that duration, they require to be processed by pasteurisation prior to being containerised. To effect this processing pasteurising machines of various configurations are already known in each of which liquid to be pasteurised is temperature elevated to above ambient and maintained at the elevated temperature for a predetermined duration. The elevated temperature is usually in the range 60°–75° C. and the predetermined duration is usually in the range 15 seconds to 30 minutes.

It is an object of the present invention to provide integrated filling and pasteurising apparatus for liquids.

According to the present invention there is provided an integrated filling and pasteurising apparatus comprising a filling machine and a pasteurising machine, said pasteurising machine having a balance tank for temporary storage of product to be pasteurised, a pasteurising station coupled to receive product from the balance tank and to deliver pasteurised product to the filling machine, said filling machine comprising a hopper coupled to receive pasteurised product from said pasteurising station, a container-filling station coupled to the output of the hopper, drive means for sequentially delivering containers to be filled to the filling station and for sequentially moving filled containers from the filling station to a container-closure station, wherein control means are provided for controlling operation of said drive means to provide synchronous operation of said pasteurising machine and of said filling machine.

Figure 1:
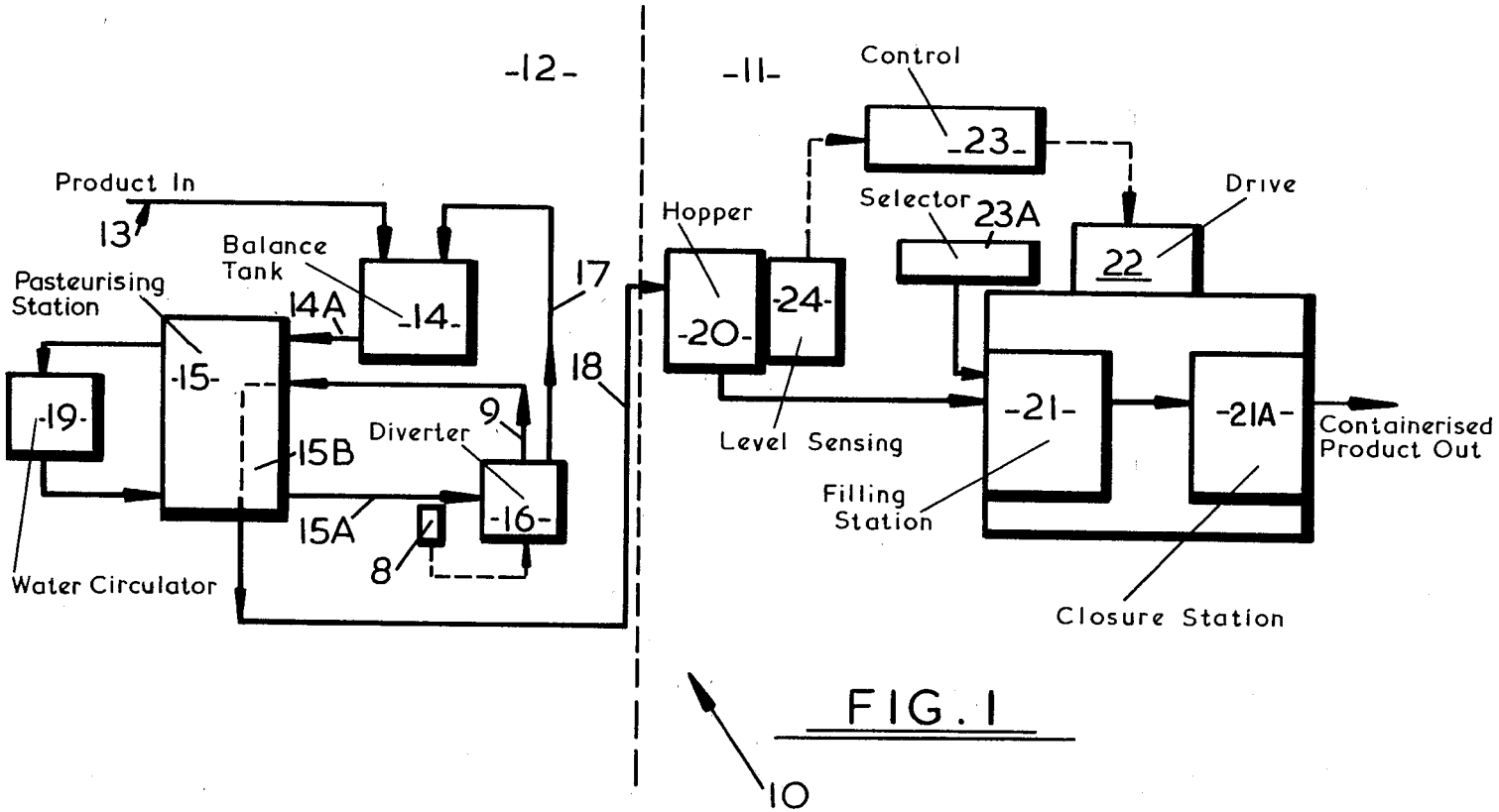

Embodiments of the present invention will now be described by way of example with reference to the accompanying drawings in which:

FIG. 1 diagrammatically illustrates the invention in block form; and

Figure 2:
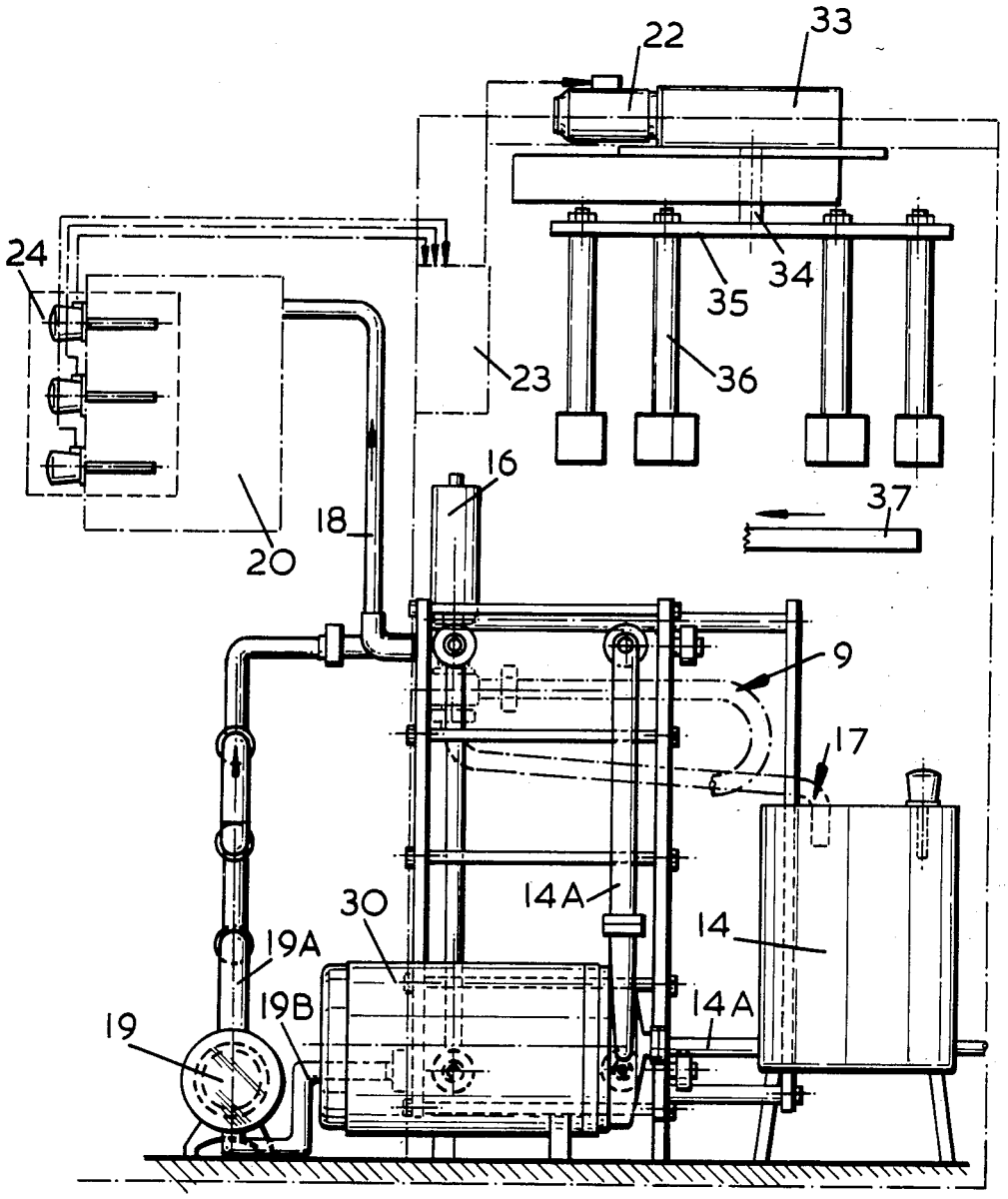
Figure 3:
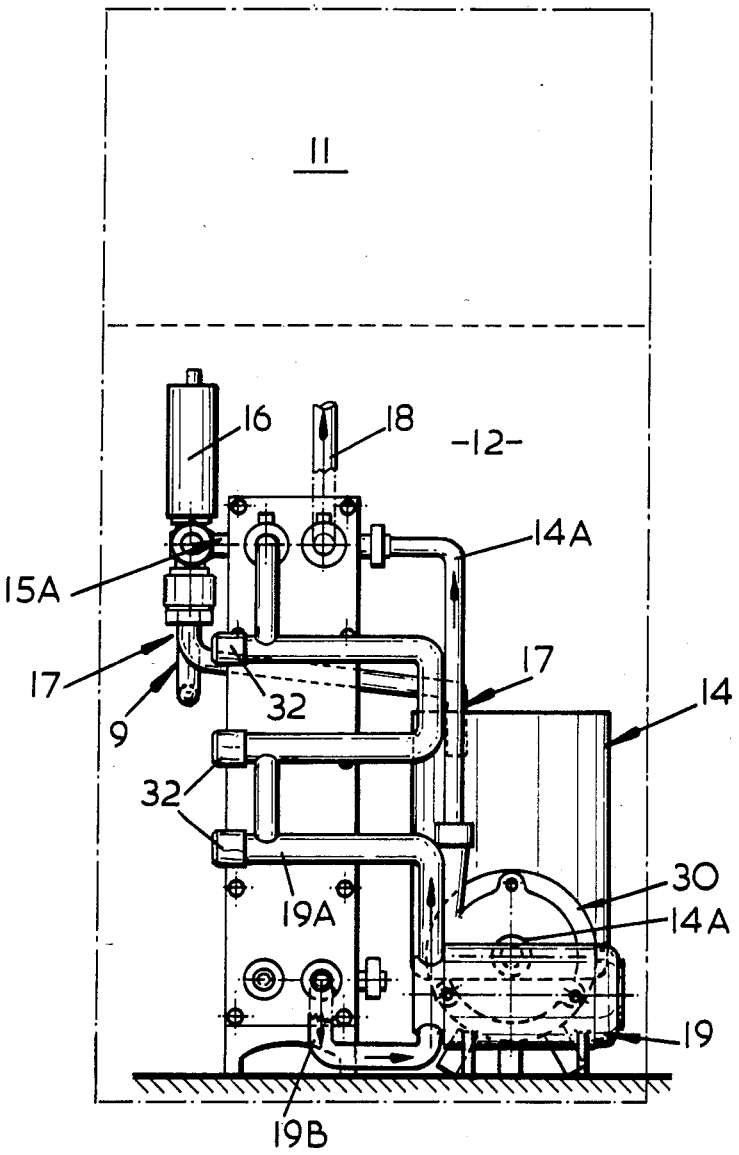
Figure 4:
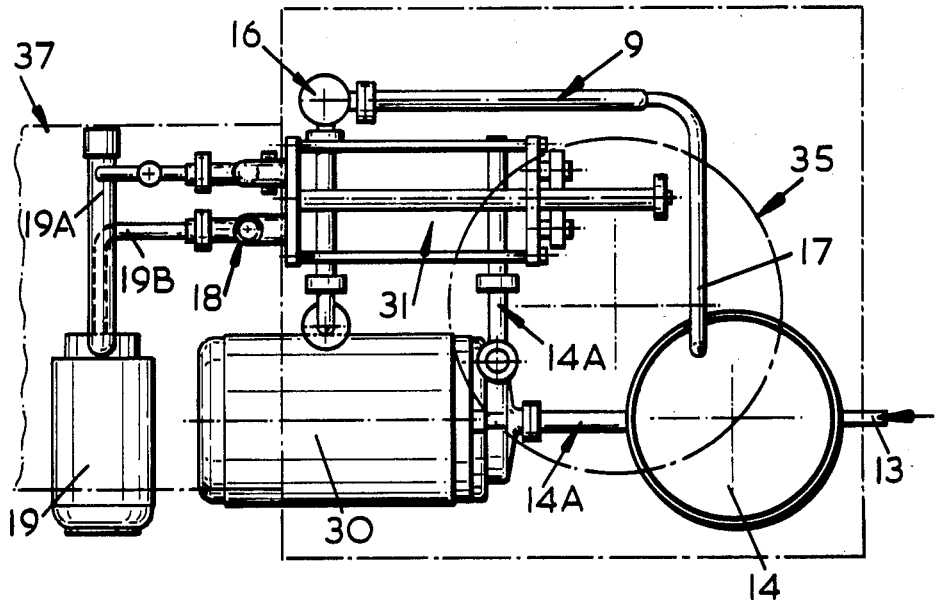

FIGS. 2, 3 and 4 show an implementation of the invention in front elevation, side elevation and plan views respectively.

In FIG. 1 of the drawing an integrated filling and pasteurising apparatus 10 comprises a filling machine 11 and a pasteurising machine 12. Machine 12 comprises a product inlet 13 through which product to be pasteurised is delivered to a balance tank 14. The output of the tank 14 delivers product via line 14A to a pasteurising station 15 and pasteurised product from station 15 is delivered on line 15A to a diverter 16. A temperature sensor 8 at the input of diverter 16 controls diverter 16 to output the product either to the balance tank 14 via line 17, should the product require reprocessing, or via line 9 to a cooling section 15B within station 15 and hence to the filling machine 11 should the product be fully pasteurised.

In order to effect pasteurisation at station 15 the product is temperature elevated for a predetermined duration and in this embodiment this is achieved by a water circulator 19 which circulates water along a closed path incorporating electrical water heating elements (not shown), this path being separated from the product flow path within station 15 by one or more plates. It will be noted that the drawing is diagrammatic and whilst it does illustrate water and product contra-flow for the purpose of efficient heat exchange it does not define particular flow orientation nor does it define pumping which may be necessary in the product flow path.

Filling machine 11 receives pasteurised liquid from the cooling section 15B of station 15 via line 18 which delivers into a hopper 20 acting as an accumulator or buffer between the pasteurising machine 12 which of necessity operates with a continuous flow output and the filling machine 11 which operates with a discontinuous or intermittent flow output. The output of hopper 20 is fed to a container-filling station 21 at which a succession of empty containers is presented for respectively receiving a measured quantity of the pasteurised liquid. Delivery of empty containers to the station 21 is effected by a drive 22 which also progresses filled containers to a container-closure station **21*a*** where the filled containers are sealed or closed and from which the containerised product is delivered.

Drive 22 is an indexing drive which operates discontinuously and in addition to container movement controls the discontinuous delivery of metered quantities of product from hopper 20. Drive 22 is itself under the influence of a control 23 which operates according to a level sensor 24 associated with hopper 20, the arrangement being such that drive 22 provides synchronous continuous operation of machines 11 and 12 despite the inherent conflicting requirements for normal operation of the respective machines 11, 12.

A selector 23A may be set at any one setting from a range of settings such as container sizes 0.5, 1.0, 1.5, 2.0 liters etc. in order to define the volumetric quantity of product to fill each container.

Level sensor 24 provides a plurality of signals representative of discrete product levels within hopper 20 and provided the sensed level does not exceed a predetermined level, drive 22 is arranged to operate normally (i.e. discontinuously but at its normal index rate). If the predetermined level is exceeded, drive 22 is increased in speed whereby the product level within hopper 20 is constrained. If the sensed product level within hopper 20 drops below a base level, drive 22 is controlled to operate at a reduced or zero rate until such time as the sensed level within hopper 20 returns to a level at which normal operation of drive 22 can be resumed.

It will be appreciated that the apparatus 10 may take any one of a large number of configurations. Pasteurising station 15 for example may be a plate pasteuriser or an infrared pasteuriser. Product may be pumped through pasteurising station 15. Filling station 21 may be linear or circular and may be arranged to handle containers in bottle or carton form. Level sensor 24 may comprise a plurality of discrete probes or only a single probe providing a continuous (analogue) output signal requiring comparison within control 23 with a plurality of threshold levels.

Furthermore, the machines 11, 12 may be packaged within a single frame for example the pasteurising machine 12 may be located underneath a known filling machine 11 so that the apparatus 10 takes up the same space as the known filling machine 11. Such an arrangement is illustrated in FIGS. 2, 3 and 4 respectively showing front elevation, end elevation and plan views of the arrangement.

In the arrangement of FIGS. 2, 3 and 4 product to be pasteurised is circulated by main pump 30 connected in line 14A through a plate pasteuriser 31, the exit product line 15A leading into diverter valve 16. Product which is up to temperature and therefore properly pasteurised is diverted along line 9, which is in the form of a length of tubing providing a holding time interval for the product at that temperature, line 9 leading through a secondary circuit of the pasteuriser 31 which functions as cooling section 15B before emerging on line 18 which leads to hopper 20.

Water circulation pump 19 circulates water via lines 19A, 19B, line 19A containing three electrical water heaters 32 in the horizontal portions best seen in FIG. 3 whereby the water temperature is elevated and controlled to provide the required pasteurising effect on the product.

The drive motor 22 of the filling machine 11 which is controlled by a thyristor contoller 23 drives a gearbox 33 the output shaft 34 of which rotates an overhead gantry 35 having depending arms 36 which form part of a container folding mechanism whereby folded and formed containers are delivered to the filling station 21 (not shown). In this connection it will be understood that the containers are made of cardboard or plastics and initially are flat packed with no containment capacity and the folding mechanism opens each flat pack and provides a bottom seal fold to provide the relevant containment capacity.

As will be appreciated filling machine 11 is essentially located over pasteurising machine 12 and filled containers are delivered on a run-out table 37 located above water circulating pump 19.

What is claimed is:

1. An integrated filling and pasteurizing apparatus comprising a filling machine, a pasteurizing machine, and control means for providing synchronous operation of said filling machine and said pasteurizing machine;

said pasteurizing machine including a balance tank for temporary storage of the product to be pasteurized, and a pasteurizing station means coupled for receiving the product from said balance tank and for delivering the pasteurized product to said filling machine;

said filling machine including a hopper coupled for receiving the pasteurized product from said pasteurizing station means, a container-filling station means coupled for sequentially receiving metered quantities of the pasteurized product from said hopper and for sequentially filling containers with the metered quantities of the pasteurized product, container-closure station means for receiving filled containers from said container-filling station means and for closing the containers, and indexing drive means operating at varying rates for sequentially delivering containers to be filled to said container-filling station means and sequentially moving filled containers from said container-filling station means to said container-closure station means and for controlling the sequential delivery of the metered quantities of the pasteurized product from said hopper to said container-filling station means; and said control means being operatively connected with said drive means for controlling the indexing rate thereof and including liquid level sensor means associated with said hopper for emitting signals to govern the control of the indexing rate of said drive means.

2. Apparatus as claimed in claim 1, wherein said control means governs the indexing rate of said drive means to increase the indexing rate if a predetermined upper liquid level in the hopper is exceeded and to decrease the indexing rate if a predetermined lower liquid level in the hopper is not attained.

3. Apparatus as claimed in claim 1 or 2 wherein said pasteurizing machine is substantially packaged beneath said filling machine.

* * * * *